US012672693B2

(12) United States Patent
Pinder et al.

(10) Patent No.: US 12,672,693 B2
(45) Date of Patent: Jul. 7, 2026

(54) SOLE STRUCTURE WITH COMPLIANT TRACTION ELEMENTS

(71) Applicant: adidas AG, Herzogenaurach (DE)

(72) Inventors: Gillian Pinder, Moose Jaw (CA); Nicole Schrier, Vancouver, WA (US); Cori Kristine Marble Steele, Portland, OR (US); Sam Conklin, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/990,251

(22) Filed: Dec. 20, 2024

(65) Prior Publication Data

US 2026/0174176 A1 Jun. 25, 2026

(51) Int. Cl.
*A43B 5/18* (2006.01)

(52) U.S. Cl.
CPC ..... *A43B 5/185* (2013.01)

(58) Field of Classification Search
CPC ..... A43C 15/16; A43C 15/168; A43C 15/161; A43C 15/14; A43B 13/223; A43B 5/02; A43B 13/26; A43B 5/185; A63C 17/20; A63C 17/008
See application file for complete search history.

(56) References Cited

U.S. PATENT DOCUMENTS

| | | | | |
|---|---|---|---|---|
| 10,058,147 | B2 | 8/2018 | Wernow et al. | |
| 11,388,947 | B1 | 7/2022 | Barnes | |
| 2002/0026731 | A1* | 3/2002 | Brahler | A43C 15/161 36/134 |
| 2014/0310995 | A1* | 10/2014 | Campari | A43C 15/08 36/134 |
| 2015/0059207 | A1* | 3/2015 | Karlsson | A43C 15/168 36/67 B |
| 2024/0251914 | A1 | 8/2024 | Rasmussen et al. | |

FOREIGN PATENT DOCUMENTS

| | | | |
|---|---|---|---|
| GB | 2506694 | A | 4/2014 |
| WO | WO 2004/037030 | A1 | 5/2004 |
| WO | WO 2008/152504 | A1 | 12/2008 |

* cited by examiner

*Primary Examiner* — Khoa D Huynh
*Assistant Examiner* — Erick I Lopez
(74) *Attorney, Agent, or Firm* — Sterne, Kessler, Goldstein & Fox P.L.L.C.

(57) ABSTRACT

Soles for articles of footwear comprising a body, a traction element comprising a base, and a shiftable region circumscribing the base and merging with the body at a perimeter of the shiftable region. The sole comprises a stay extending from the base, through the shiftable region, and to the body, and an opening located in the shiftable region, the opening comprising an outermost point relative to the base, wherein the outermost point is located at the perimeter the shiftable region. In some embodiments, the stay comprises an edge point at an outermost edge of the stay that moves relative to the body when a force is imparted to the traction element.

20 Claims, 10 Drawing Sheets

SOLE STRUCTURE WITH COMPLIANT TRACTION ELEMENTS

TECHNICAL FIELD

The present disclosure relates to a sole structure for a shoe, in particular a shoe with one or more compliant traction elements, and a shoe comprising the sole structure.

BACKGROUND

When engaging in athletic activities, there exists a risk of injury to a joint of the lower body (such as an ankle joint or knee joint) during the athletic activity. In some instances, the risk can be at least partially attributed to the use of traction elements (such as cleats, studs, etc.) on shoes worn during the athletic activities. For example, during an attempt to change directions, the traction elements on a shoe can engage with a ground surface to limit movement of the shoe (for example, linear and/or rotational movement) relative to the ground surface. While the traction elements are engaged with the ground surface, the lower body joints of the athlete can continue to move relative to the ground surface (for example, linearly and/or rotationally), thereby increasing the risk of injury to the lower body joints. Hence, there is a continuing need for athletic shoes designed to improve athletic performance while minimizing risk of injury.

BRIEF SUMMARY

A first embodiment (I) of the present disclosure is directed to an article of footwear, comprising: an upper; and a sole coupled to the upper, the sole comprising: a body; a traction element comprising a base; a shiftable region circumscribing the base and merging with the body at a perimeter of the shiftable region; a stay extending from the base, through the shiftable region, and to the body; and an opening located in the shiftable region, the opening comprising an outermost point relative to the base, wherein the outermost point is located at the perimeter the shiftable region, wherein the stay comprises an edge point at an outermost edge of the stay that moves relative to the body when a force is imparted to the traction element.

In a second embodiment (II), the article of footwear of the first embodiment (I) comprises a cover disposed over the opening on a ground-facing surface of the sole.

In a third embodiment (III), the article of footwear of any one of embodiments (I)-(II) comprises an elastically deformable material located in the opening.

In a fourth embodiment (IV), in the article of footwear of the third embodiment (III), the elastically deformable material comprises a foam.

In a fifth embodiment (V), the article of footwear of any one of embodiments (I)-(IV) comprises an elastically deformable layer disposed over an upper-facing side of the sole.

In a sixth embodiment (VI), in the article of footwear of the fifth embodiment (V), the elastically deformable layer comprises a foam.

In a seventh embodiment (VII), in the article of footwear of any one of embodiments (I)-(VI), the body, the base, and the stay are integrally formed as a single piece.

In an eighth embodiment (VIII), in the article of footwear of any one of embodiments (I)-(VII), the traction element comprises a cleat.

In a ninth embodiment (IX), in the article of footwear of any one of embodiments (I)-(VIII), the sole comprises a plurality of the traction elements and a plurality of the shiftable regions, and each of the traction elements is circumscribed by a respective one of the shiftable regions.

In tenth embodiment (X), in the article of footwear of any one of embodiments (I)-(IX), a radial distance between the edge point and the body is greater than or equal to 0.5 mm and less than or equal to 45 mm when the force is not imparted to the traction element.

In an eleventh embodiment (XI), in the article of footwear of any one of embodiments (I)-(X), the edge point translates relative to the body when the force is imparted to the traction element.

In a twelfth embodiment (XII), in the article of footwear of the eleventh embodiment (XI), the edge point is configured to translate relative to the body along a first axis that is parallel to a longitudinal axis of the base, along a second axis that is parallel to a transverse axis of the base, and along a third axis that is orthogonal to the longitudinal axis and the transverse axis when the force is imparted to the traction element.

In a thirteenth embodiment (XIII), in the article of footwear of any one of embodiments (I)-(XII), the edge point rotates relative to the body when the force is imparted to the traction element.

In a fourteenth embodiment (XIV), in the article of footwear of the thirteenth embodiment (XIII), the edge point is configured to rotate relative to the body about a first axis that is parallel to a longitudinal axis of the base, about a second axis that is parallel to a transverse axis of the base, and about a third axis that is orthogonal to the longitudinal axis and the transverse axis when the force is imparted to the traction element.

In a fifteenth embodiment (XV), in the article of footwear of any one of embodiments (I)-(XIV), the shiftable region comprises an interior boundary located at an outer boundary of the base and comprises a first effective diameter, and the perimeter of the shiftable region comprises a second diameter at least 2 mm greater than the first effective diameter.

In a sixteenth embodiment (XVI), in the article of footwear of any one of embodiments (I)-(XV), the stay is a first stay and the shiftable region comprises a second stay separated from the first stay by the opening.

In a seventeenth embodiment (XVII), in the article of footwear of any one of embodiments (I)-(XVI), the stay comprises multiple connection points with the base.

In an eighteenth embodiment (XVIII), in the article of footwear of any one of embodiments (I)-(XVII), the shiftable region comprises a plurality of the openings, and each of the plurality of openings comprises an arc shape surrounding part of the base.

A nineteenth embodiment (XIX) of the present disclosure is directed to a sole for an article of footwear, comprising: a body; a traction element comprising a base; a shiftable region circumscribing the base and merging with the body at a perimeter of the shiftable region; a stay extending from the base, through the shiftable region, and to the body; and an opening located in the shiftable region, the opening comprising an outermost point relative to the base, wherein the outermost point is located at the perimeter the shiftable region, wherein the stay comprises a first point at an outermost edge of the stay and the body comprises a second point, and the first point translates relative to the second point when a force is imparted to the traction element such that there is a change in distance between the first point and the second point.

In a twentieth embodiment (XX), in the sole of the nineteenth embodiment (XIX), the first point rotates relative to the second point when the force is imparted to the traction element such that there is a change in angle between first point and second point.

In a twenty-first embodiment (XXI), in the sole of any one of embodiments (XIX)-(XX), the first point is configured to translate relative to the second point along a first axis that is parallel to a longitudinal axis of the base, along a second axis that is parallel to a transverse axis of the base, and along a third axis that is orthogonal to the longitudinal axis and the transverse axis when the force is imparted to the traction element.

In a twenty-second embodiment (XXII), in the sole of the twenty-first embodiment (XXI), the first point translates relative to the second point based on translation of the traction element relative to the body.

In a twenty-third embodiment (XXIII), in the sole of any one of embodiments (XXI)-(XXII), the first point is configured to translate greater than or equal to 0.3 mm and less than or equal to 45 mm along the first axis, the second axis, the third axis, or a combination thereof.

In a twenty-fourth embodiment (XIV), in the sole of any one of embodiments (XIX)-(XIII), the first point is configured to rotate relative to the second point about a first axis that is parallel to a longitudinal axis of the base, about a second axis that is parallel to a transverse axis of the base, and about a third axis that is orthogonal to the longitudinal axis and the transverse axis when the force is imparted to the traction element.

In a twenty-fifth embodiment (XXV), in the sole of the twenty-fourth embodiment (XXIV), the first point rotates relative to the second point based on rotation of the traction element relative to the body.

In a twenty-sixth embodiment (XXVI), in the sole of any one of embodiments (XXIV)-(XXV), the first point is configured to rotate greater than or equal to 1 degree and less than or equal to 20 degrees about the first axis, the second axis, the third axis, or a combination thereof.

In a twenty-seventh embodiment (XXVII), in the sole of any one of embodiments (XIX)-(XXIV), the traction element translates within a plane that is tangent to the body at the base when the force is imparted to the traction element.

In a twenty-eighth embodiment (XXVIII), in the sole of the twenty-seventh embodiment (XXVII), the traction element translates perpendicular to the plane when the force is imparted to the traction element.

In a twenty-ninth embodiment (XXIX), in the sole of any one of embodiments (XIX)-(XXVIII), the traction element rotates relative to a plane that is tangent to the body at the base when the force is imparted to the traction element.

BRIEF DESCRIPTION OF THE DRAWINGS/FIGURES

DETAILED DESCRIPTION

Figure 1A:
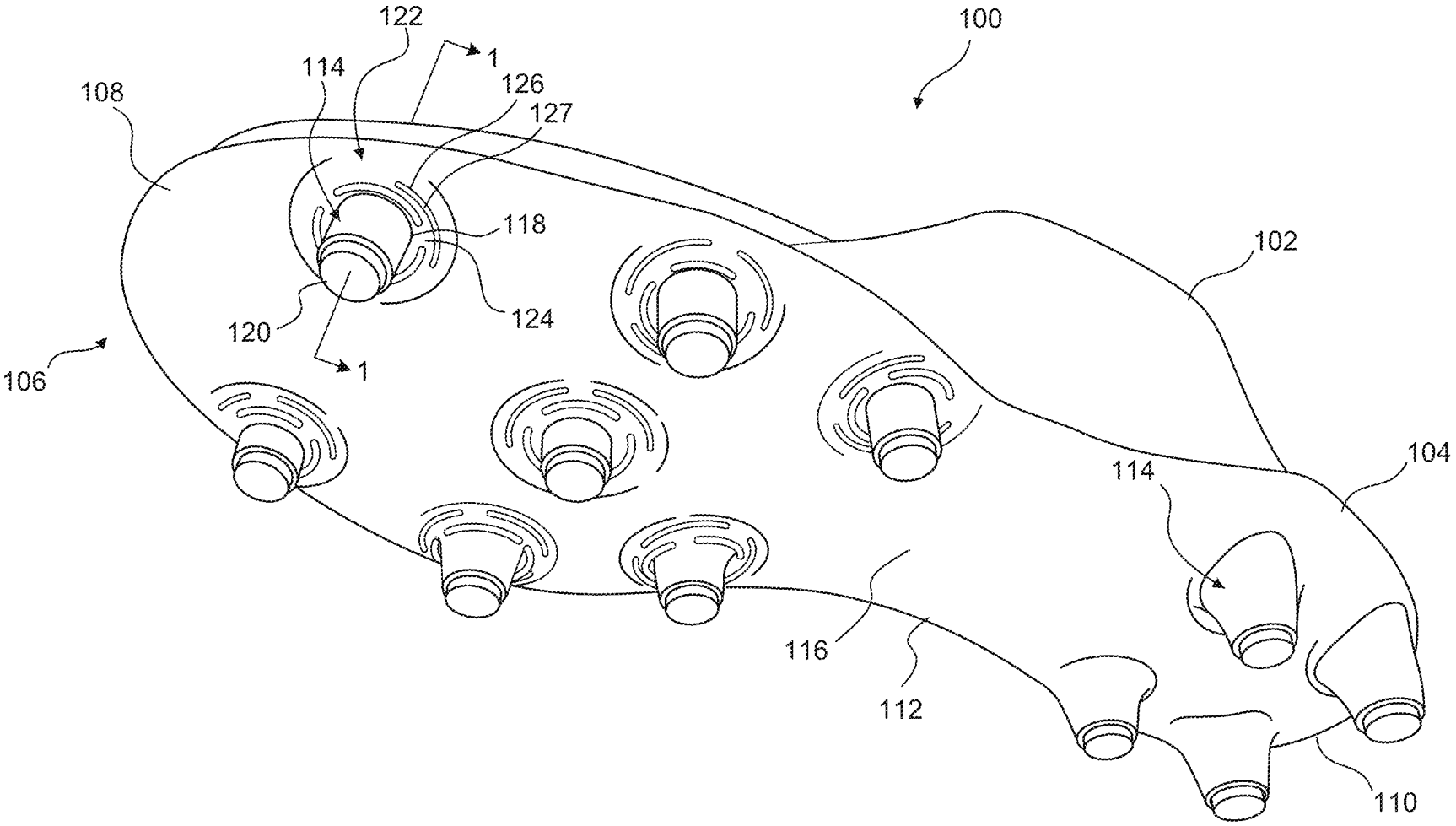
FIG. 1A shows a bottom perspective view of a shoe, according to some embodiments.

The indefinite articles "a," "an," and "the" include plural referents unless clearly contradicted or the context clearly dictates otherwise.

As used herein, unless specified otherwise, references to "first," "second," "third," "fourth," etc. are not intended to denote order, or that an earlier-numbered feature is required for a later-numbered feature. Also, unless specified otherwise, the use of "first," "second," "third," "fourth," etc. does not necessarily mean that the "first," "second," "third," "fourth," etc. features have different properties or values.

The term "comprising" is an open-ended transitional phrase. A list of elements following the transitional phrase "comprising" is a non-exclusive list, such that elements in addition to those specifically recited in the list can also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed.

The term "effective diameter" is used herein to describe the size or shape of a component (for example, a base of a traction element), and this term should not be interpreted as requiring the component to have a circular shape. The component can have a circular or non-circular shape. In embodiments comprising a circular shape, the term "effective diameter" refers to the diameter of the circle. In embodiments comprising a non-circular shape, the term "effective diameter" refers to the maximum cross-sectional dimension of the shape. For example, the "effective diameter" of a component having an elliptical shape would be the length of the major axis of the elliptical shape. As another example, the "effective diameter" of a component having a rectangular shape would be the largest diagonal of the rectangular shape.

The term "merge" is used herein to describe a direct connection between two components (for example, a shiftable region and a body of a sole), and should not be interpreted as requiring two components to be formed from a continuous piece of material. In some embodiments, the two components can be formed as a continuous piece of material such that the connection is seamless. In other embodiments, the two components can be formed as distinct components and then joined together with a direct connection between the two components. In such embodiments, there can be a scam or some other indication of the connection between the components.

Sole structures according to embodiments of the present application are designed to provide various advantageous effects for a wearer. The sole structures can permit at least some relative motion between the sole structures and the wearer when participating in a sport, for example football, in which the sole structures comprise traction elements. Providing relative motion between sole structures and the wearer can apply less stress to lower body joints of the wearer during movements such as changing directions, slowing down, etc., thereby providing for optimal athletic performance. Sole structures according to embodiments of the present application are designed to address and/or pursue the following problems and/or objectives at least partially.

Sole structures for athletic shoes that have traction elements such as cleats, spikes, studs, etc., typically have the traction elements extending from a ground-facing surface of the sole structure such that the traction elements cannot move relative to the ground-facing surface. Thus, when the traction elements engage the ground (for example, when the wearer changes directions, slows down, etc.), stress on lower body joints of the wearer (from, for example, relative movement of the lower body joints relative to the sole structure) cannot be relieved or reduced by relative movement between the traction elements and the ground-facing surface of the sole.

Sole structures according to embodiments of the present disclosure can allow for relative motion between lower body joints of the wearer and the ground, thereby relieving some of the stress on the those joints during athletic movements such as changing directions, slowing down, etc. For example, sole structures of the present disclosure can comprise a traction element comprising a base and a shiftable region that circumscribes the base and merges with a body of the sole. An opening can be located in the shiftable region, and a stay can extend from the base, through the shiftable region, and to the body. During engagement between the traction element and the ground, the stay can move within the opening of the shiftable region such that the traction element can move relative to the body.

The design of shiftable regions according to embodiments of the present disclosure allows relative movement between a traction element in contact with the ground and the rest of the sole structure. In various embodiments described herein, the design of the shiftable regions allows the traction element to translate relative to the sole structure when force is imparted to the traction element. For example, the design of the shiftable region can allow the traction element translate relative to the body along a longitudinal axis, a transverse axis, and/or a vertical axis when the force is imparted to the traction element. In particular, the design of the shiftable regions allows one or more points within the shiftable region to translate relative to the sole structure when force is imparted to the traction element, as described herein. In various embodiments described herein, the design of the shiftable regions alternatively or additionally allows the traction element to rotate relative to the sole structure when force is imparted to the traction element. For example, the design of the shiftable region can allow the traction element rotate relative to the body about a longitudinal axis, a transverse axis, and/or a vertical axis when the force is imparted to the traction element. In particular, the design of the shiftable regions allows one or more points within the shiftable region to rotate relative to the sole structure when force is imparted to the traction element, as described herein. The translation and/or rotation enabled by the design of shiftable regions described herein can provide desired relative motion between sole structures and the wearer while maintaining or improving athletic performance and minimizing the risk of injury.

FIG. 1A shows a bottom perspective view of a shoe 100, according to some embodiments. In some embodiments, the shoe 100 can be used in athletic competitions such as football, American football, baseball, track and field, etc. The shoe 100 can comprise an upper 102 coupled to a sole 104. The upper 102 can cover the top and/or sides of the foot of the wearer when the wearer is wearing the shoe 100. In some embodiments, the upper 102 can comprise laces to secure the shoe 100 to the foot of the wearer. In some embodiments, the laces can be omitted and can be replaced with a different structure (for example, an elastic band) to secure the shoe 100 to the foot of the wearer.

The sole 104 can be coupled to the upper 102 in various ways. In some embodiments, the sole 104 can be coupled to the upper 102 by, for example, an adhesive, stitching, a connector (for example, a threaded connector), or a combination thereof. In some embodiments, the sole 104 can be coupled to the upper 102 by injecting the sole 104 directly on to the upper 102 (for example, by injection molding). In some embodiments, the sole 104 and the upper 102 can be additively manufactured such that the upper 102 can be printed directly on the sole. In some embodiments, the sole 104 and the upper 102 can be additively manufactured separately and later joined together (for example, by an adhesive). In some embodiments, the sole 104 can comprise materials such as rubber (natural or synthetic), polyurethane (PU), thermoplastic polyurethane (TPU), polyamide (PA), a composite, or any other material that can provide the functions disclosed herein. In some embodiments, the sole 104 can comprise one material. In some embodiments, the sole 104 can comprise a combination of two or more materials. In some embodiments, the sole 104 can be manufactured by, for example, injection molding, machining, additive manufacturing (3-D printing), or a combination thereof. In some embodiments, the upper 102 can be manufactured by, for example, injection molding, machining (for example, milling, turning, drilling, etc.), additive manufacturing, or a combination thereof. In embodiments where the upper 102 and the sole 104 can be manufactured with an additive manufacturing process, the sole 104 and the upper 102 can be manufactured together during the same additive manufacturing process or the sole 104 and the upper 102 can be manufactured separately and then joined together.

In some embodiments, the sole 104 can comprise a body 106 that can comprise a forefoot portion 108, a heel portion 110, and a midfoot portion 112. The forefoot portion 108 can be located underneath a forefoot of the wearer (for example, the portion of the foot of the wearer that comprises the toes), the heel portion 110 can be located underneath a heel of the wearer, and the midfoot portion 112 can be located underneath all or a portion of a midfoot of the wearer (for example, the portion of the foot of the wearer that comprises the arch of the foot).

Sole 104 comprises at least one traction element 114 extending away from the body 106. For example, the traction element 114 can extend away from a ground-facing surface 116 of the sole 104. In some embodiments, the traction element 114 can engage a ground surface (such as grass, dirt, turf, etc.) when the ground-facing surface 116 of the sole 104 contacts the ground surface. For example, when the ground-facing surface 116 of the sole 104 contacts the ground surface, the traction element 114 can engage the ground surface such that the traction element 114 extends into the ground surface (for example, to provide support to the wearer when the wearer makes an athletic movement such as changing directions, slowing down, etc.). In some embodiments, the traction element 114 can comprise a cleat, a spike, a stud, or any other type of structure that can engage a ground surface as described.

In some embodiments, the traction element 114 can be located on the forefoot portion 108. In some embodiments, the traction element 114 can be located on the heel portion 110. In some embodiments, the sole 104 can comprise more than one traction element 114. In some embodiments, the sole 104 can comprise more than one traction element 114 such that multiple traction elements 114 are located on the forefoot portion 108. In some embodiments, the sole 104 can comprise more than one traction element 114 such that multiple traction elements 114 are located on the heel portion 110. In some embodiments, the sole 104 can comprise more than one traction element 114 such that traction elements 114 can be located on both the forefoot portion 108 and the heel portion 110. In some embodiments, traction elements 114 can be located on the forefoot portion 108, the heel portion 110, and the midfoot portion 112.

Traction element 114 comprises a base 118 and a tip 120. The base 118 can be located closer to the ground-facing surface 116 than the tip 120 such that, when the traction element 114 engages the ground surface, the tip 120 engages the ground surface before the base 118.

The traction element 114 can move relative to the body 106 in response to a force exerted on the traction element 114. For example, the traction element 114 can move relative to the body 106 when a force is exerted on the traction element 114 by the ground (such as when the traction element 114 engages the ground during an athletic movement such as changing directions, slowing down, etc.). In some embodiments, the traction element 114 can translate (for example, move linearly) relative to the body 106. In some embodiments, the traction element 114 can rotate relative to the body 106. In some embodiments, the traction element 114 can both translate and rotate relative to the body 106 in response to a force exerted on the traction element 114. Movement of the traction element 114 relative to the body 106 can relieve or reduce stress on lower body joints of the wearer (for example, ankle joints, knee joints, hip joints, etc.) during athletic movements.

To facilitate movement of the traction element 114 relative to the body 106, the sole 104 can comprise a shiftable region 122 disposed around the base 118. In some embodiments, the shiftable region 122 can circumscribe the base 118. In some embodiments, the shiftable region 122 can merge with the body 106 at a perimeter of the shiftable region 122. In some embodiments, the sole 104 can comprise a stay 124 that extends from the base, through the shiftable region 122, and to the body 106 such that the base 118 is connected to the body 106 via the stay 124. In some embodiments, an opening 126 can be located in the shiftable region 122. In some embodiments, the base 118, the stay 124, and the opening 126 interact with each other when a force is exerted on the traction element 114 to facilitate movement of the traction element 114 relative to the body 106. For example, the stay 124 can move within the shiftable region 122 when a force is exerted on traction element 114 such that the traction element 114 can move relative to the body 106. The structure of, and interaction between, the base 118, the stay 124, and the opening 126 are further described with reference to FIGS. 2-3.

Figure 1B:
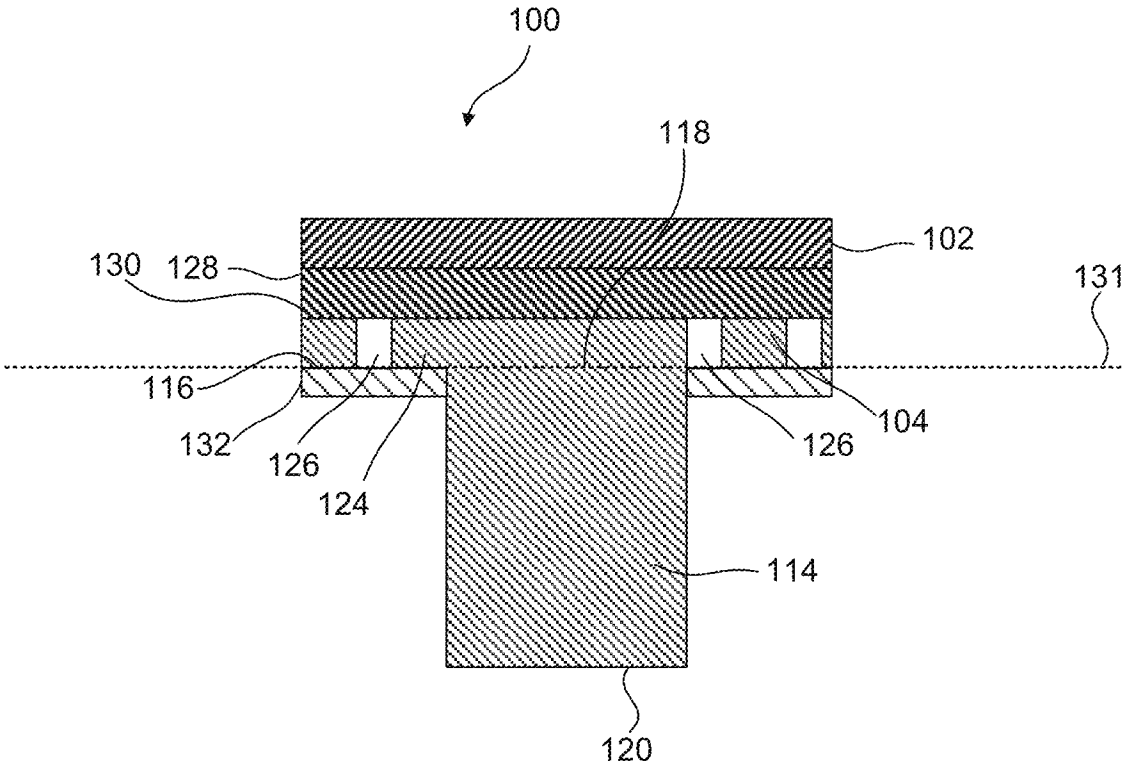
FIG. 1B shows a cross-sectional view of a portion of the shoe of FIG. 1A, according to some embodiments.

FIG. 1B shows a cross-sectional view of a portion of the shoe 100 across 1-1, according to some embodiments. In some embodiments, the sole 104 can comprise a deformable layer 128 disposed over an upper-facing side 130 of the sole 104. In some embodiments, the deformable layer 128 can be disposed between the upper-facing side 130 and the upper 102. In some embodiments, the deformable layer 128 can comprise an elastically deformable material that can be compressed when a force is imparted to the deformable layer 128, and can return to its original configuration when the force is removed. In some embodiments, the deformable layer 128 can comprise a foam material.

In some embodiments, the deformable layer 128 can facilitate movement of the traction element 114 toward the upper 102. For example, when a force is exerted on the traction element 114, the force can be transferred to the deformable layer 128 by the traction element 114 such that the deformable layer 128 compresses. As the deformable layer 128 compresses, the traction element 114 can move in the direction the deformable layer 128 is compressed (for example, in a vertical direction toward the upper 102). When the force is removed, the deformable layer 128 can return to its original configuration, thereby moving the traction element 114 in the opposite direction to return the traction element 114 to its position before the force was exerted. In some embodiments, the base 118 can be located within a plane 131 that is tangent to the body 106 at the base 118. In such embodiments, when the traction element 114 moves in the vertical direction toward the upper, the base 118 moves out of the plane 131, and when the traction element 114 moves in the opposite direction to return to its original position, the base moves into the plane 131.

In some embodiments, sole 104 can comprise a component configured to limit or prevent debris (for example, dirt, grass, rubber, etc.) from entering the opening 126. Limiting or preventing debris from entering the opening 126 can allow movement of the stay 124 to allow the traction element 114 to function as described herein. In some embodiments, entry of debris into the opening 126 can be limited or prevented by a cover 132 disposed over the opening 126 on the ground-facing surface 116 of the sole 104. In some embodiments, the cover 132 can comprise a foil that can be coupled to the ground-facing surface 116 of the sole 104.

In some embodiments, the sole 104 can comprise an elastically deformable material 127 located in the opening 126. In some embodiments, the elastically deformable material 127 can comprise a foam material. The elastically deformable material 127 can limit or prevent debris from entering the opening 126. The elastically deformable material 127 can also allow movement between the stay 124 and the body 106 when a force is exerted on the traction element 114, and can aid in moving the stay 124 back to its position when the force is removed.

In some embodiments, two or more of the components of the sole 104 can be integrally formed as a single piece. For example, two or more components of the sole 104 can be additively manufactured as a single piece. In some embodiments, the body 106, the base 118, and the stay 124 can be integrally formed as a single piece. In some embodiments, the base 118 and the stay 124 can be integrally formed as a single piece, and the body 106 can be formed as a separate piece that can be coupled to the stay 124. In some embodiments, the stay 124 and the body 106 can be integrally formed as a single piece, and the base 118 can be formed as a separate piece that can be coupled to the stay 124.

Figure 2A:
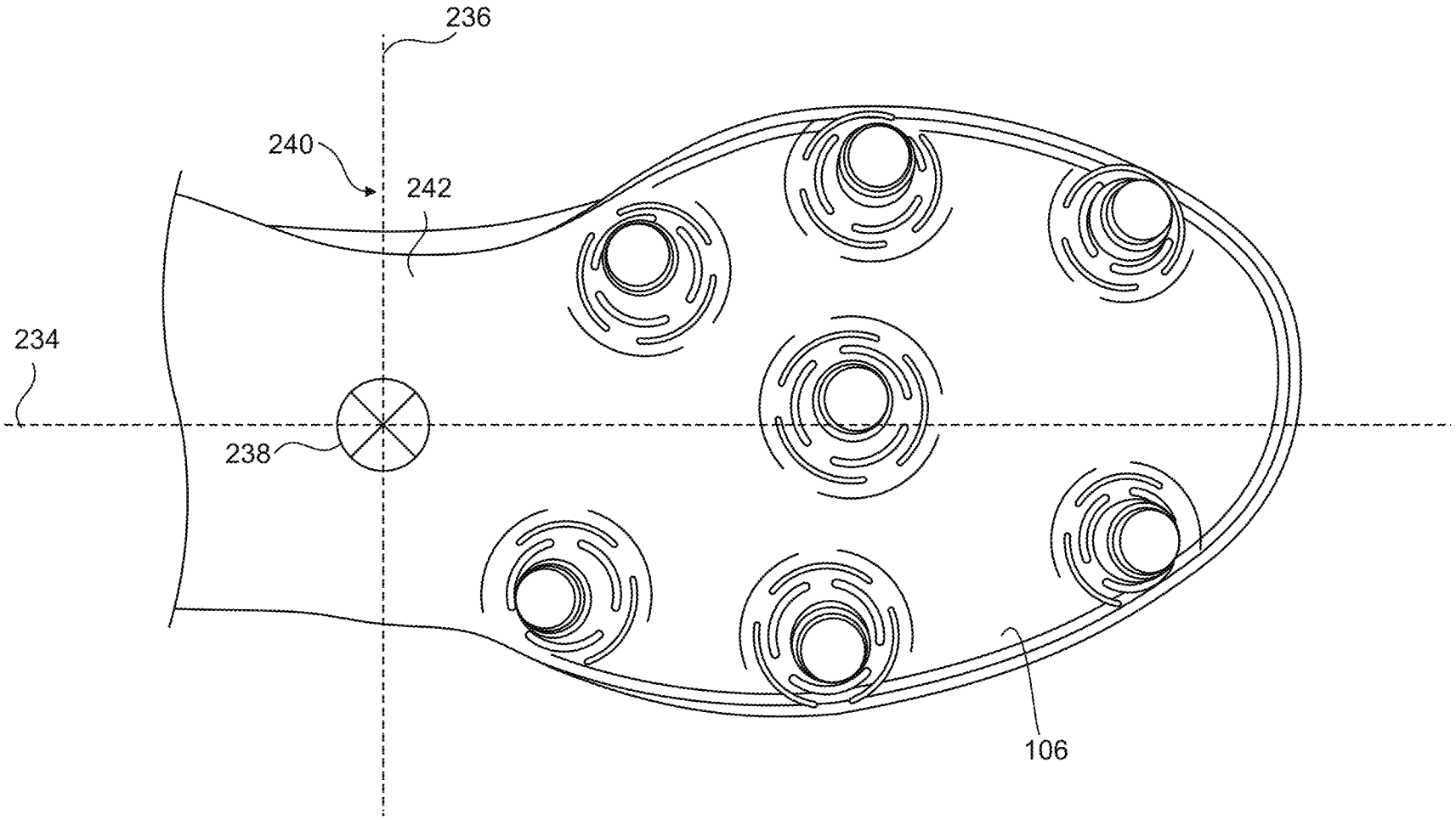
FIG. 2A shows a bottom view of a shoe, according to some embodiments.
Figure 2B:
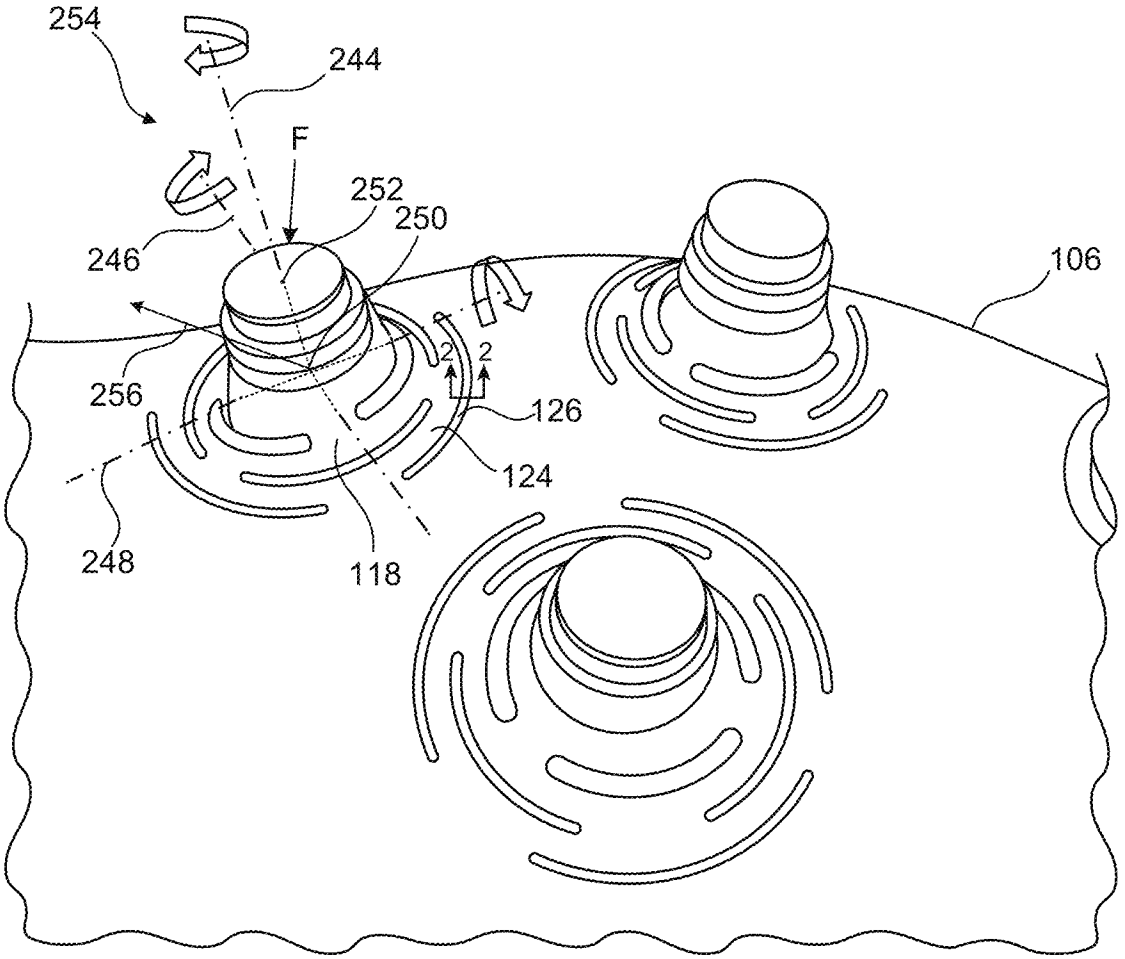
FIG. 2B shows a bottom perspective view of a sole, according to some embodiments.
Figure 2C:
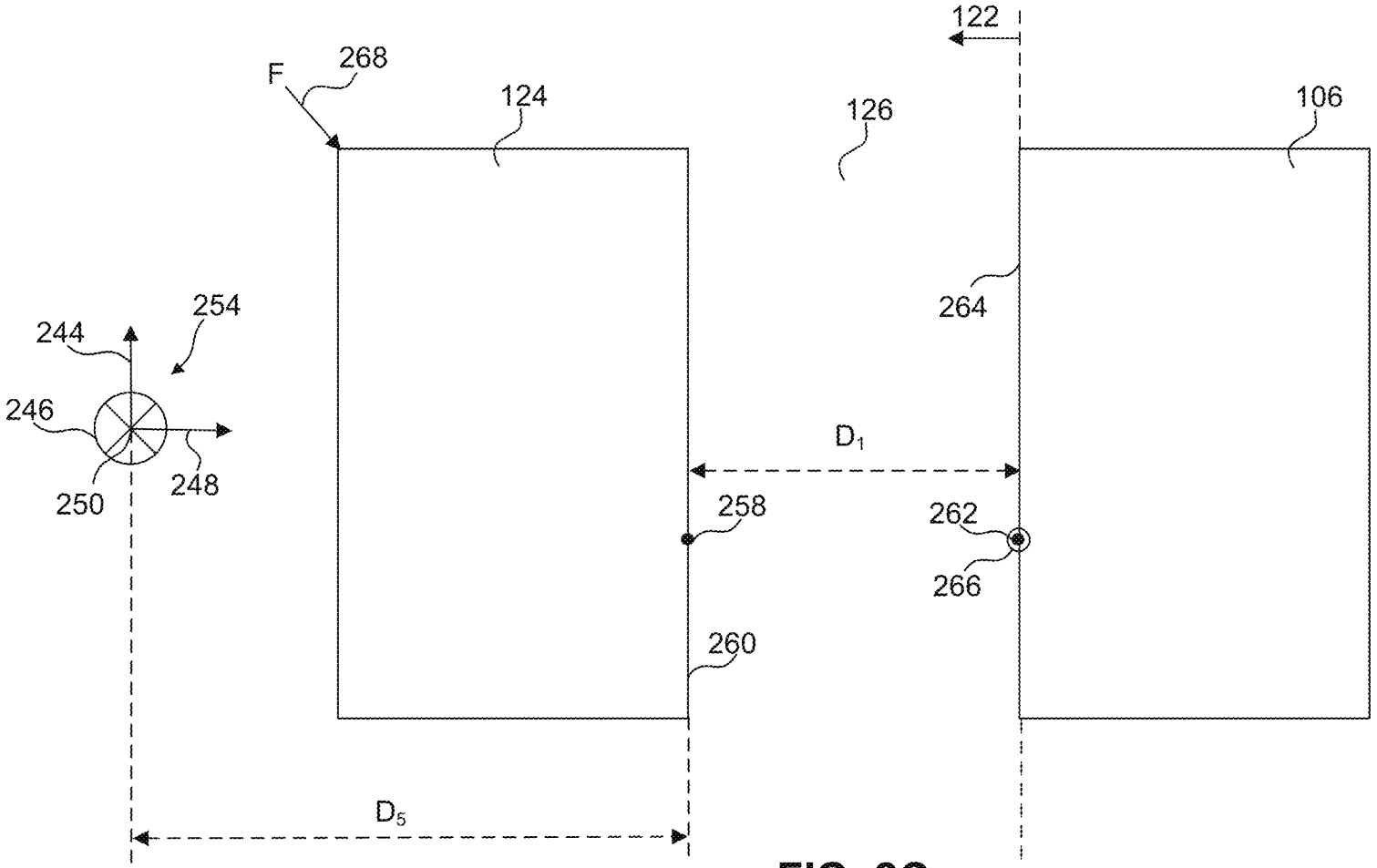
FIGS. 2C-2D shows cross-sectional views of a portion of the sole of FIGS. 2A-2B, according to some embodiments.
Figure 2D:
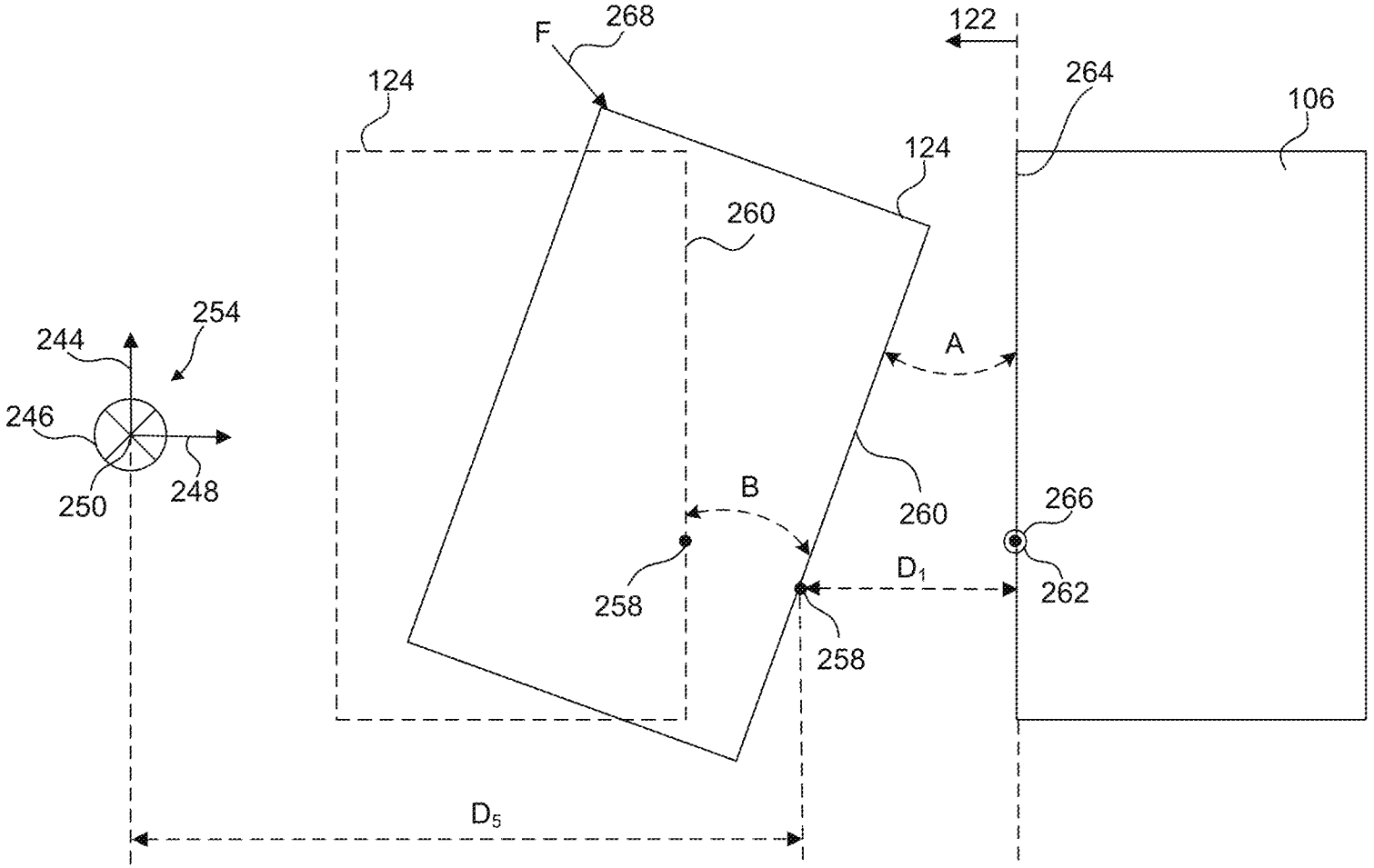

FIGS. 2A-2D show various views of the sole 104 of the shoe 100, according to some embodiments. FIG. 2A shows a bottom view of the sole 104, according to some embodiments. FIG. 2B shows a bottom perspective view of the sole 104, according to some embodiments. FIGS. 2C-2D show cross-sectional views of a portion of the sole 104 across 2-2, according to some embodiments.

In some embodiments (such as the embodiment shown in FIG. 2A), the sole 104 can comprise a forward/rearward axis 234 that is oriented in a heel/toe direction. In some embodiments, the sole 104 can comprise a medial/lateral axis 236 that is oriented in a medial/lateral direction (for example, an inner-foot to outer-foot direction) and a top/bottom axis 238 that is oriented vertically in a top-foot to bottom-foot direction. In some embodiments, the forward/rearward axis 234, medial/lateral axis 236, and top/bottom axis 238 can each be orthogonal to each other, thereby creating a coordinate system 240 with an origin located at a central portion 242 of the sole 104. In some embodiments, the central portion 242 can be a center of mass of the sole 104.

In some embodiments (such as shown in FIG. 2B), the traction element 114 can comprise a longitudinal axis 244 that extends through a center 250 of the base 118 and a center 252 of the tip 120. In some embodiments, the traction element 114 can comprise a lateral axis 246 that is oriented in the medial/lateral direction and a transverse axis 248 that is oriented in the heel/toe direction. In some embodiments, the longitudinal axis 244, the lateral axis 246, and the transverse axis 248 can each be orthogonal to each other, thereby creating a coordinate system 254 with an origin located at the center 250 of the base 118. In some embodiments, the lateral axis 246 and the transverse axis 248 can lie within a plane that is tangent to the body 106 at the base 118.

In some embodiments, the sole 104 can comprise a plurality of traction elements 114, and each traction element 114 of the plurality of traction elements 114 can comprise its own coordinate system (for example, a local coordinate system) similar to the coordinate system 254. In some embodiments, each respective coordinate system can comprise a plane 131 tangent to the body 106 at the base 118 of the respective traction element 114 (for example, plane 131 described with reference to FIG. 1B). The plane 131 can comprise the lateral axis 246 and the transverse axis 248 of the respective traction element 114. Additionally, in some embodiments the sole 104 can comprise a plurality of shiftable regions 122, where each traction element 114 can be circumscribed by a respective one of the shiftable regions 122.

In some embodiments, the ground-facing surface 116 of the sole 104 can comprise various contours such that the ground-facing surface 116 of the sole 104 does not lie in a single plane. Accordingly, at least some of the respective local coordinate systems associated with at least some of the traction elements 114 can be oriented obliquely (for example, non-parallel) to other respective local coordinate systems of other traction elements 114 and to the coordinate system 240 (for example, a global coordinate system of the sole 104).

During use, a force F can be imparted to the traction element 114 when the wearer of the shoe 100 changes directions, slows down, etc. In some embodiments, the force F can be oriented parallel to one of the longitudinal axis 244, the lateral axis 246, or the transverse axis 248. In some embodiments, the force F can be oriented obliquely to the longitudinal axis 244, the lateral axis 246, and the transverse axis 248. For purposes of explanation, movement of the traction element 114 when the force F is imparted obliquely to the longitudinal axis 244, the lateral axis 246, and the transverse axis 248 will be described.

As described herein, when the force Fis imparted to the traction element 114, the traction element 114 can be configured to move relative to the body 106. Movement of the traction element 114 relative to the body 106 can at least partially absorb some of the energy associated with the wearer changing directions, slowing down, etc. Such absorption of energy can, among other things, reduce some of the stress on the lower body joints of the wearer during such movements. In some embodiments, the traction element 114 can translate relative to the body 106 in response to the force F being imparted to the traction element 114. In some embodiments, the traction element 114 can translate in any direction defined by a vector 256 within the coordinate system 254. For example, the vector 256 can be directed along the longitudinal axis 244, the lateral axis 246, or the transverse axis 248 in response to the force F. As another example, the vector 256 can be directed between a combination of two or more of the longitudinal axis 244, the lateral axis 246, or the transverse axis 248.

In some embodiments, the traction element 114 can translate within and/or relative to a plane that is tangent to the body 106 at the base 118. For example, the plane can be defined by the transverse axis 248 and the lateral axis 246, and the traction element 114 can translate within the plane in response to the force F. In some embodiments, the traction element 114 can translate perpendicular to the plane (for example, into or out of the plane along the longitudinal axis 244) in response to the force F.

In some embodiments, the traction element 114 can rotate relative to the body 106 in response to the force F being imparted to the traction element 114. In some embodiments, the traction element 114 can rotate about one or more of the longitudinal axis 244, the lateral axis 246, or the transverse axis 248 in response to the force F. In some embodiments, the traction element 114 can rotate relative to the plane that is tangent to the body 106 at the base 118.

Accordingly, movement of the traction element 114 relative to the body 106 can result in movement of the coordinate system 254 (for example, a local coordinate system for the traction element 114) relative to the coordinate system 240 (for example, a global coordinate system for the sole 104). More specifically, the center 250 (for example, the origin of the coordinate system 254) can move relative to the central portion 242 (for example, the origin of the coordinate system 240) of the sole 104 when the traction element 114 moves relative to the body 106.

In some embodiments, each of the traction elements 114 can move differently based on the forces imparted to each respective traction element 114 when the traction elements 114 engage the ground surface. In some embodiments, each traction element 114 can move within its respective shiftable region 122 based on the force imparted to each respective traction element 114. For example, the wearer can change directions by engaging the medial portion of the body 106 with the ground surface and leaving the lateral portion of the body 106 disengaged with the ground surface. In this example embodiment, each of the traction elements 114 located on the medial portion of the body 106 can move relative to the body 106 based on the forces imparted to the traction elements 114 by the ground surface, and each of the traction elements 114 located on the lateral portion of the body 106 can remain stationary relative to the body 106 because no forces are being imparted to the traction elements 114 by the ground surface. Thus, each traction element 114 can move separately and independently from the remaining traction elements 114.

In some embodiments, movement of the traction element 114 relative to the body 106 can be described in terms of movement of a stay 124 relative to an opening 126 and/or the body 106. For example, FIGS. 2C-2D show cross-sectional views of a portion of a stay 124 relative to a portion of the body 106 across 2-2. In some embodiments, the stay 124 can comprise an edge point 258 located at an outermost edge 260 of the stay 124. In some embodiments, the opening 126 can comprise an outermost point 262 relative to the base 118 such that the outermost point 262 is located at a perimeter of the shiftable region 122. In some embodiments, the perimeter of the shiftable region 122 can be defined by an edge 264 of the body 106. For example, the shiftable region 122 can extend from the base 118 to the edge 264. In some embodiments, the body 106 can comprise an edge point 266 located at the edge 264. In some embodiments, the edge point 266 can be coincident with the outermost point 262.

In some embodiments, when the traction element 114 is not exposed to a force (for example, the force F of FIG. 2B), the edge point 258 and the body 106 can be separated by a distance $D_1$. In some embodiments, the distance $D_1$ can be referred to as a radial distance (for example, the distance between the edge point 258 and the body 106 along a radius drawn from the center 252, through the edge point 258, to the body 106). In some embodiments, the radial distance between the edge point 258 and the body 106 can be greater than or equal to 0.5 mm. In some embodiments, the radial distance between the edge point 258 and the body 106 can be greater than or equal to 1 mm. In some embodiments, the radial distance between the edge point 258 and the body 106 can be greater than or equal to 0.5 mm and less than or equal to 45 mm. In some embodiments, the radial distance between the edge point 258 and the body 106 can be greater than or equal to 1 mm and less than or equal to 45 mm. In some embodiments, the radial distance between the edge point 258 and the body 106 can be greater than or equal to 2 mm and less than or equal to 45 mm.

In some embodiments, when the force F is imparted to the traction element 114, the traction element 114 can translate relative to the body 106. More specifically, in some embodiments, the base 118 can translate relative to the body 106 when the force Fis imparted to the traction element. Translation of the base 118 can cause the stay 124 to translate relative to the body 106. In such embodiments, when the traction element 114 translates relative to the body 106, the edge point 258 can be configured to translate relative to the body 106 such that there is a change in the distance $D_1$. For example, when the force F is imparted to the traction element 114, the edge point 258 can translate relative to the body 106 such that distance $D_1$ changes along an axis that is parallel to the longitudinal axis 244, the edge point 258 can translate relative to the body 106 such that distance $D_1$ changes along an axis that is parallel to the lateral axis 246, the edge point 258 can translate relative to the body 106 such that distance $D_1$ changes along an axis that is parallel to the transverse axis 248, or any combination thereof.

In some embodiments, the edge point 258 can translate greater than or equal to 0.3 mm and less than or equal to 45 mm along the axis that is parallel to the longitudinal axis 244, along the axis that is parallel to the lateral axis 246, along the axis that is parallel to the transverse axis 248, or a combination thereof. In some embodiments, the edge point 258 can translate greater than or equal to 0.2 mm and less than or equal to 45 mm along the axis that is parallel to the longitudinal axis 244, along the axis that is parallel to the lateral axis 246, along the axis that is parallel to the transverse axis 248, or a combination thereof. In some embodiments, the edge point 258 can translate greater than or equal to 0.1 mm and less than or equal to 45 mm along the axis that is parallel to the longitudinal axis 244, along the axis that is parallel to the lateral axis 246, along the axis that is parallel to the transverse axis 248, or a combination thereof. In the example embodiment shown in FIGS. 2C-2D, the edge point 258 can be located a distance $D_5$ from the origin of the coordinate system 254 (for example, the center 250 of the base 118) along the transverse axis 248. In some embodiments, the stay 124 can translate along the transverse axis 248 and away from the origin of the coordinate system 254 such that the distance $D_5$ increases. In some embodiments, the stay 124 can translate along the transverse axis 248 and toward the origin of the coordinate system 254 such that the distance $D_5$ decreases. Though the distance $D_5$ is shown along the transverse axis 248, in some embodiments the distance $D_5$ can be along the longitudinal axis 244, the lateral axis 246, the transverse axis 248, or a combination thereof.

In some embodiments, when the force F is imparted to the traction element 114, the traction element 114 can rotate relative to the body 106. More specifically, in some embodiments, the base 118 can rotate relative to the body 106 when the force Fis imparted to the traction element 114. In some embodiments, translation of the edge point 258 can cause rotation of the traction element 114. For example, as the distance $D_5$ changes based on the force F, an angular position of the edge point 258 relative to the origin of the coordinate system 254 can change. Furthermore, the larger the change in the distance $D_5$ based on the force F, the larger the change in the angular position of the edge point 258 relative to the origin of the coordinate system 254. In some embodiments, when the traction element 114 rotates relative to the body 106, the edge point 258 can be configured to rotate relative to the body 106 (for example, relative to the edge point 266) about an axis that is parallel to the longitudinal axis 244, about an axis that is parallel to the lateral axis 246, about an axis that is parallel to the transverse axis 248, or any combination thereof.

In the example embodiment shown in FIG. 2D, the stay 124 is shown in its initial position (for example, before the force F being imparted to the traction element 114) in dotted lines and in a moved position (for example, during the force F being imparted to the traction element 114) in solid lines. As a result of the force F, the stay 124 can translate along the transverse axis 248 and rotate about an axis parallel to the lateral axis 246. More specifically, the edge point 258 on the outermost edge 260 can translate along the transverse axis 248 and can rotate about an axis parallel to the lateral axis 246.

In some embodiments, the edge point 258 can rotate an angle B greater than or equal to 1 degree and less than or equal to 20 degrees about the axis that is parallel to the longitudinal axis 244, about the axis that is parallel to the lateral axis 246, and/or about the axis that is parallel to the transverse axis 248. In some embodiments, the edge point 258 can rotate greater than or equal to 1 degree and less than or equal to 25 degrees about the axis that is parallel to the longitudinal axis 244, about the axis that is parallel to the lateral axis 246, and/or about the axis that is parallel to the transverse axis 248. In some embodiments, the edge point 258 can rotate greater than or equal to 1 degree and less than or equal to 30 degrees about the axis that is parallel to the longitudinal axis 244, about the axis that is parallel to the lateral axis 246, and/or about the axis that is parallel to the transverse axis 248.

In some embodiments, translation of the edge point 258 of approximately 0.3 mm (for example, along the longitudinal axis 244, along the lateral axis 246, along the transverse axis 248, or a combination thereof) when the distance $D_5$ is approximately 15 mm can result in a rotation of the edge point 258 of approximately 1 degree (for example, about an axis parallel to the longitudinal axis 244, about an axis parallel to the lateral axis 246, about an axis parallel to the transverse axis 248, or a combination thereof). In some embodiments, translation of the edge point 258 of approximately 45 mm (for example, along the longitudinal axis 244, along the lateral axis 246, along the transverse axis 248, or a combination thereof) when the distance $D_5$ is approximately 120 mm can result in a rotation of the edge point 258 of approximately 20 degrees (for example, about an axis parallel to the longitudinal axis 244, about an axis parallel to the lateral axis 246, about an axis parallel to the transverse axis 248, or a combination thereof).

Accordingly, in some embodiments, the traction element 114 (and thus, the edge point 258) can move with 6 degrees of freedom (for example, translation along and rotation about 3 orthogonal axes of the coordinate system 254) relative to the body 106 when the force Fis imparted to the traction element 114.

In an example embodiment, the force F can be imparted to the traction element 114 in the direction indicated by the arrow 268 shown in FIG. 2D. The force F can be transferred from the base 118 to the stay 124 such that the force F can be imparted to the stay 124 in the direction indicated by the arrow 268. Based on the force F, the stay 124 can move relative to the body 106. For example, the stay 124 can translate relative to the body 106 in the manner described above such that the distance $D_1$ between the stay 124 and the body 106 decreases. The stay 124 can also rotate relative to the body 106 in the manner described above such that an angle A between the outermost edge 260 and the edge 264 changes. For example, prior to the force F being imparted to the traction element 114 (as shown in FIG. 2C), the outermost edge 260 and the edge 264 can be oriented approximately parallel to each other (for example, within 10 degrees of parallel). During application of the force F to the traction element 114, the outermost edge 260 and the edge 264 can be oriented at an angle A to each other. Thus, the outermost edge 260 can rotate relative to the edge 264 such that there can be a change in the angle A between the outermost edge 260 and the edge 264. Furthermore, because the edge point 258 can be on the outermost edge 260 and the edge point 266 can be on the edge 264, the edge point 258 can rotate relative to the edge point 266 such that there can be a change in the angle A between the edge point 258 and the edge point 266. In some embodiments, the change in the angle A between the edge point 258 and the edge point 266 can be the same as the change in the angle A between the outermost edge 260 and the edge 264.

The movement of the stay 124 relative to the body 106 can be dependent on the direction of the force F. In the example above, the force F was exerted in such a way as to cause the distance $D_1$ to decrease. In some embodiments, the force F can be exerted in such a way as to cause the distance $D_1$ to increase. Similarly, the angle A can change based on the direction of the force F.

FIGS. 3A-3M show bottom views of shiftable regions 122, according to some embodiments. A shiftable region as described herein comprises an interior boundary (for example, interior boundary 370) located at an outer boundary (for example, outer boundary 372) of the base 118 of a traction element 114. The interior boundary of the shiftable region is defined by the effective diameter of the base 118 (for example, $D_2$ shown in FIG. 3A) that is located at the outer boundary of the base 118 and that intersects with an innermost point of the opening(s) in the shiftable region. A shiftable region as described herein also comprises a perimeter (for example, perimeter 376) located where the shiftable region merges with the base 106. The perimeter of the shiftable region is defined by a circle coaxially surrounding the interior boundary of the shiftable region. The circle comprises a diameter (for example, $D_4$ in FIG. 3A) that is greater than the effective diameter of the base 118 and that intersects with an outermost point of the opening(s) in the shiftable region. Together, the interior boundary of a shiftable region and the perimeter of a shiftable region can define a ring-shaped area circumscribing a traction element 114. FIGS. 3A-3M illustrate interior boundaries and perimeters for each of the shiftable regions.

A shiftable region as described herein also comprises at least one opening 126 and at least one stay 124. A stay 124 in a shiftable region is defined by a continuous piece of material extending from the interior boundary of the shiftable region to the perimeter of the shiftable region or to an edge of an opening located at the perimeter of the shiftable region 122. A stay 124 can comprise a continuous surface extending from the base 118, through the shiftable region 122, and to the body 106 or to an edge of an opening located at the perimeter of the shiftable region 122. For example, any point on the stay 124 can be reached from any other point on the stay 124 without crossing over any opening 126. In some embodiments, a shiftable region can comprise a single stay 124. For example, in the embodiment shown in FIG. 3A, the shiftable region 122 has only one stay 124.

In some embodiments, a stay 124 can comprise multiple connection points with a base 118 at the interior boundary of the shiftable region. In some embodiments, a stay can comprise a single connection point with a base 118 at the interior boundary of the shiftable region. In some embodiments, a stay 124 can comprise multiple connection points with the body 106 at the perimeter of the shiftable region. In some embodiments, a stay 124 can comprise a single connection point with the body 106 at the perimeter of the shiftable region. In some embodiments, a shiftable region can comprise multiple stays 124.

An opening 126 in a shiftable region is bounded at least partially by one or more stays 124 of the shiftable region. In some embodiments, a shiftable region can comprise multiple openings 126. For example, as shown in FIG. 3A, the shiftable region 122 has nine openings 126.

Figure 3A:
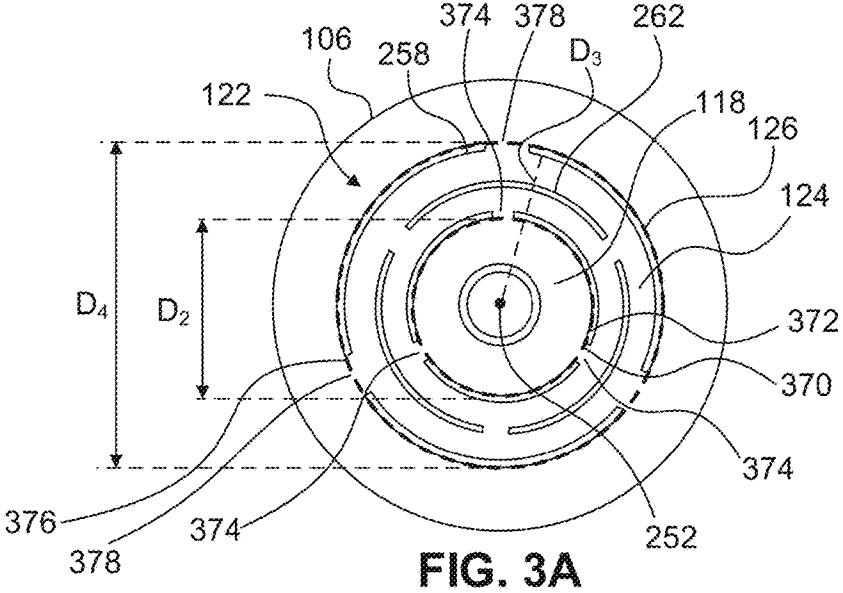
FIGS. 3A-3M show bottom views of shiftable regions, according to some embodiments.

FIG. 3A shows a bottom view of the shiftable region 122, according to some embodiments. The shiftable region 122 comprises an interior boundary 370 located at an outer boundary 372 of the base 118 and comprising an effective diameter $D_2$. The shiftable region 122 also comprises a perimeter 376 defined by a radial distance $D_3$ from the center 252 to the outermost point 262 of the opening 126 (for example, the perimeter 376 can be determined by multiplying the radial distance $D_3$ by $2\pi$). In other words, the perimeter 376 of the shiftable region 122 can comprise a diameter $D_4$. In some embodiments, the diameter $D_4$ can be at least 2 mm greater than $D_2$. In some embodiments, the diameter $D_4$ can be at least 5 mm greater than $D_2$. In some embodiments, the diameter $D_4$ can be at least 20 mm greater than $D_2$. In some embodiments, the diameter $D_4$ can be at least 30 mm greater than $D_2$. In some embodiments, the diameter $D_4$ can be at least 40 mm greater than $D_2$. In some embodiments, the difference between the diameter $D_4$ and $D_2$ can be greater than or equal to 2 mm and less than or equal to 100 mm. In some embodiments, the difference between the diameter $D_4$ and $D_2$ can be greater than or equal to 10 mm and less than or equal to 90 mm. In some embodiments, the difference between the diameter $D_4$ and $D_2$ can be greater than or equal to 20 mm and less than or equal to 80 mm. In some embodiments, the difference between the diameter $D_4$ and $D_2$ can be greater than or equal to 30 mm and less than or equal to 70 mm. In some embodiments, the difference between the diameter $D_4$ and $D_2$ can be greater than or equal to 40 mm and less than or equal to 60 mm.

In some embodiments, the stay 124 of shiftable region 112 shown in FIG. 3A can comprise multiple connection points 374 with the base 118 at the interior boundary 370. In some embodiments, the connection points 374 can be evenly spaced around the interior boundary 370. In some embodiments, the connection points 374 can be unevenly spaced around the interior boundary 370. In some embodiments, the stay 124 can comprise multiple connection points 378 with the body 106 at the perimeter 376. In some embodiments, the connection points 378 can be evenly spaced around the perimeter 376. In some embodiments, the connection points 378 can be unevenly spaced around the perimeter 376.

As shown in FIG. 3A, in some embodiments, the shiftable region 122 can comprise a plurality of openings 126. In some embodiments, each of the plurality of openings 126 can comprise an arc shape that surrounds part of the base 118. In some embodiments, the plurality of openings 126 can comprise discontinuous concentric rings that extend radially outward from the interior boundary 370. In some embodiments, an innermost ring of the discontinuous concentric rings can comprise the same diameter (for example, $D_2$) as the interior boundary 370, and an outermost ring of the discontinuous concentric rings can comprise the same diameter (for example, $D_4$) as the perimeter 376.

FIGS. 3B-3M show various shiftable regions that are described in further detail below. In some embodiments, any of the shiftable regions described herein (for example, the shiftable region 122 or any of the shiftable regions described with reference to FIGS. 3B-3M) can be implemented in place of, or in addition to, any of the other shiftable regions described herein. For example, the sole 104 can comprise a plurality of shiftable regions that can all be the same (such as the shiftable region 122). As another example, the sole 104 can comprise a plurality of shiftable regions that can each be different. More specifically, in some embodiments, the sole 104 can comprise the shiftable region 122 and a combination of one or more of the shiftable regions described with reference to FIGS. 3B-3M. Though the components of the shiftable regions described with reference to FIGS. 3B-3M can be arranged differently from each other and from the components of the shiftable region 122, each of the shiftable regions described herein can function in a manner similar to that described with respect to the shiftable region 122 (for example, each of the shiftable regions described with reference to FIGS. 3B-3M can translate and/or rotate relative to the body 106 in a manner similar to that described with reference to the shiftable region 122). Exemplary edge points 258 that can translate and/or rotate as described herein are shown in each of FIGS. 3B-3M.

Figure 3B:
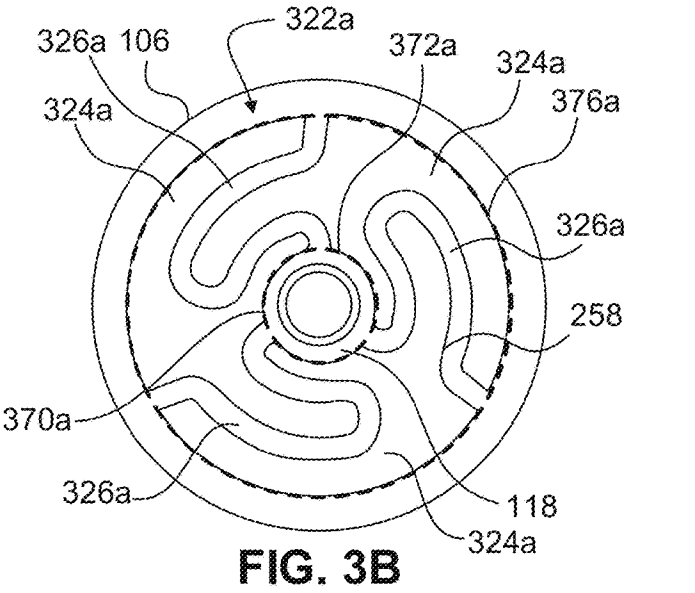

FIG. 3B shows a bottom view of a shiftable region 322*a*, according to some embodiments. Shiftable region 322*a* comprises a perimeter 376*a* and an interior boundary 370*a* located at an outer boundary 372*a* of the base 118. The shiftable region 322*a* comprises a stay 324*a* extending from the base 118, through the shiftable region 322*a*, and to the body 106. Shiftable region 322*a* also comprises an opening 326*a* extending from the base 118, through the shiftable region 322*a*, and to the body 106. In some embodiments, the opening 326*a* can extend in a non-linear manner from the base 118, through the shiftable region 322*a*, and to the body 106. In some embodiments, the opening 326*a* can extend in a serpentine or switchback manner from the base 118, through the shiftable region 322*a*, and to the body 106. In some embodiments, the shiftable region 322*a* can comprise multiple stays 324*a* (for example, a first stay, a second stay, etc.) and multiple openings 326*a*, where each stay 324*a* can be separated from an adjacent stay 324*a* by one of the openings 326*a*. For example, the shiftable region 322*a* can comprise three of the stays 324*a* and three of the openings 326*a*. In some embodiments, the stays 324*a* and the openings 326*a* can be arranged concentrically about the base 118.

Figure 3C:
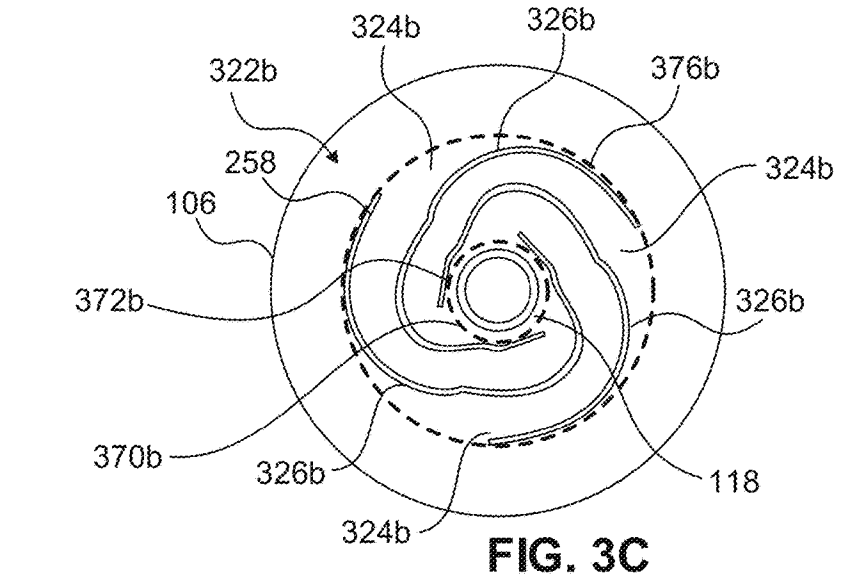

FIG. 3C shows a bottom view of a shiftable region 322*b*, according to some embodiments. Shiftable region 322*b* can comprises a perimeter 376*b* and an interior boundary 370*b* located at an outer boundary 372*b* of the base 118. Shiftable region 322*b* comprises a stay 324*b* extending from the base 118, through the shiftable region 322*b*, and to the body 106. Shiftable region 322*b* also comprises an opening 326*b* extending from the base 118, through the shiftable region 322*b*, and to the body 106. In some embodiments, the opening 326*b* can extend in a non-linear manner from the base 118, through the shiftable region 322*b*, and to the body 106. In some embodiments, the opening 326*b* can extend in a spiral manner from the base 118, through the shiftable region 322*b*, and to the body 106. In some embodiments, the shiftable region 322*b* can comprise multiple stays 324*b* (for example, a first stay, a second stay, etc.) and multiple openings 326*b*, where each stay 324*b* can be separated from an adjacent stay 324*b* by one of the openings 326*b*. For example, the shiftable region 322*b* can comprise three of the stays 324*b* and three of the openings 326*b*. In some embodiments, the stays 324*b* and the openings 326*b* can be arranged concentrically about the base 118.

Figure 3D:
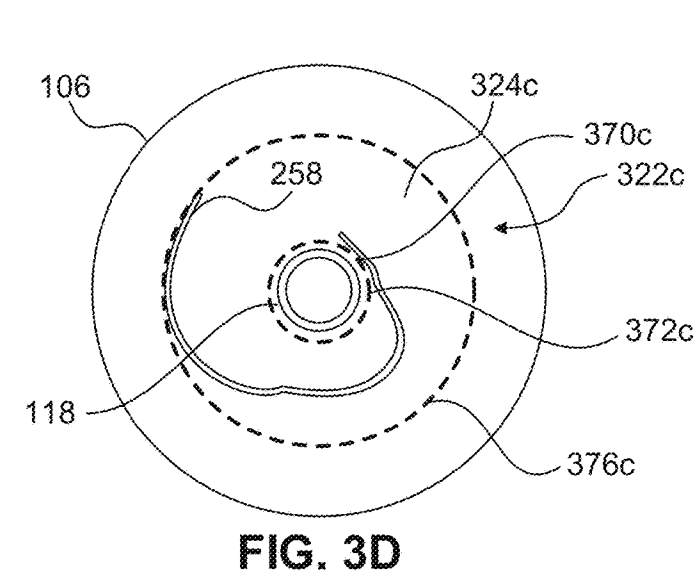

FIG. 3D shows a bottom view of a shiftable region 322*c*, according to some embodiments. Shiftable region 322*c* comprises a perimeter 376*c* and an interior boundary 370*c* located at an outer boundary 372*c* of the base 118. Shiftable region 322*c* comprises a stay 324*c* extending from the base 118, through the shiftable region 322*c*, and to the body 106. Shiftable region 322*c* also comprises an opening 326*c* extending from the base 118, through the shiftable region 322*c*, and to the body 106. In some embodiments, the opening 326*c* can extend in a non-linear manner from the base 118, through the shiftable region 322*b*, and to the body 106. In some embodiments, the opening 326*c* can extend in a spiral manner from the base 118, through the shiftable region 322*c*, and to the body 106.

Figure 3F:
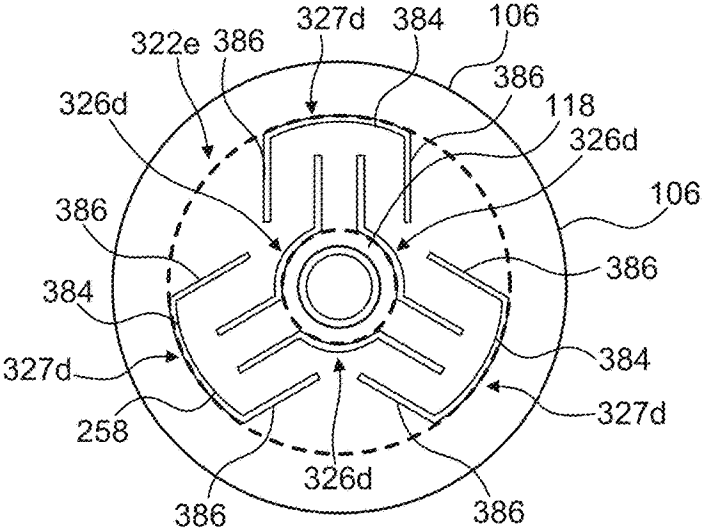
Figure 3H:
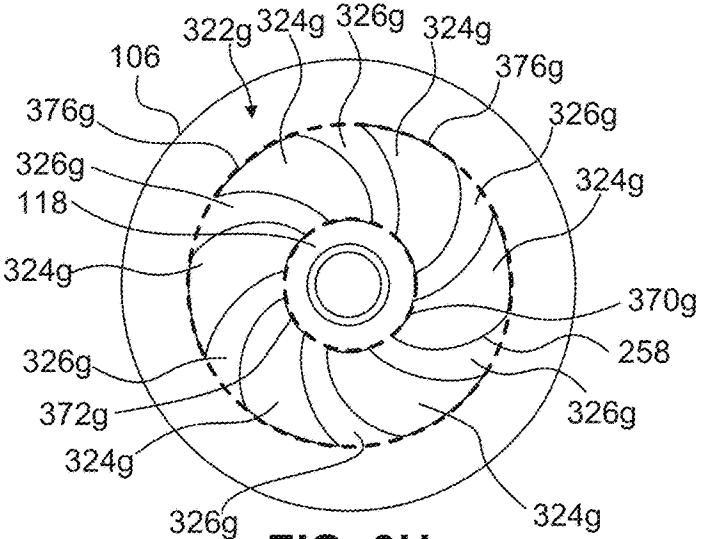
Figure 3E:
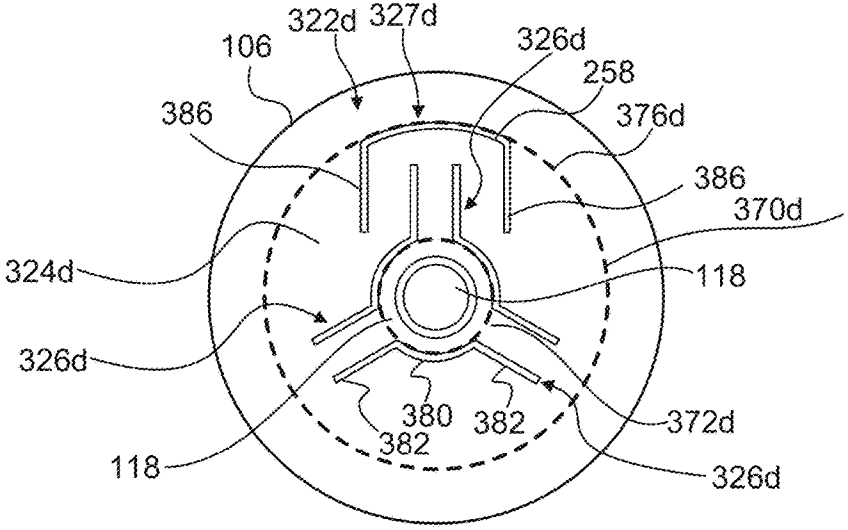

FIG. 3E shows a bottom view of a shiftable region 322*d*, according to some embodiments. Shiftable region 322*d* comprises a perimeter 376*d* and an interior boundary 370*d* located at an outer boundary 372*d* of the base 118. Shiftable region 322*d* comprises a stay 324*d* extending from the base 118, through the shiftable region 322*d*, and to the body 106. Shiftable region 322*d* also comprises an opening 326*d* extending from the base 118 and partially through the shiftable region 322*d*. In some embodiments, the opening 326*d* can comprise a curved portion 380 located at the interior boundary 370*d* and one or more radial portions 382 extending toward the perimeter 376*d*. In some embodiments, the shiftable region 322*b* can comprise a single stay 324*d* and multiple openings 326*d*, where the stay 324*d* can extend continuously around the multiple openings 326*d*. In some embodiments, the openings 326*d* can be arranged concentrically about the base 118. In some embodiments, the shiftable region can comprise an opening 327*d* that comprises a curved portion 384 located at the perimeter 376*d* and one or more linear portions 386 extending toward the interior boundary 370*d*. In some embodiments, at least one of the linear portions 386 can be parallel to at least one of the radial portions 382.

FIG. 3F shows a bottom view of a shiftable region 322*e*, according to some embodiments. In some embodiments, the shiftable region 322*e* can be similar to the shiftable region 322*d*, with the only difference being that the shiftable region 322*e* can comprise a plurality of the openings 327*d* arranged concentrically about the base 118.

Figure 3G:
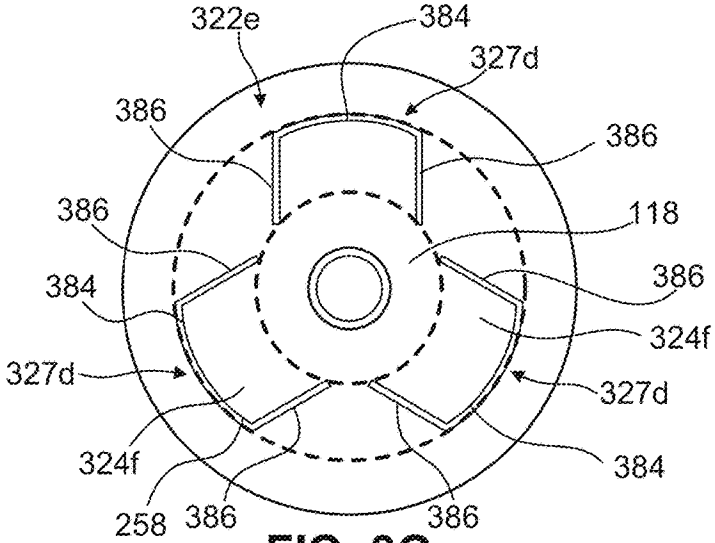

FIG. 3G shows a bottom view of a shiftable region 322*f*, according to some embodiments. In some embodiments, the shiftable region 322*f* can be similar to the shiftable region 322*e*, with the only difference being that the shiftable region 322*f* does not comprise the openings 326*d*. Accordingly, an interior boundary 370*f* of the shiftable region 322*f* can be larger than the interior boundary 370*d* of the shiftable regions 322*d* and 322*e*. For example, the interior boundary 370*f* can extend to the outer boundary of the base 118, which merges with the linear portions 386 of the openings 327*d*. Accordingly, the shiftable region 322*f* can comprise a plurality of stays 324*f*, where each stay 324*f* can be separated from an adjacent stay 324*f* by one of the linear portions 386 of the openings 327*d*. Furthermore, each of the stays 324*f* can extend from the base 118, through the shiftable region 322*a*, and to the body 106 or to an edge of the opening 327*d* at a perimeter of shiftable region 322*f*. For example, the shiftable region 322*f* can comprise six of the stays 324*f* and three of the openings 327*d*.

FIG. 3H shows a bottom view of a shiftable region 322*g*, according to some embodiments. Shiftable region 322*g* comprises a perimeter 376*g* and an interior boundary 370*g* located at an outer boundary 372*g* of the base 118. Shiftable region 322*g* comprises a stay 324*g* extending from the base 118, through the shiftable region 322*g*, and to the body 106. Shiftable region 322*g* also comprises an opening 326*g* extending from the base 118, through the shiftable region 322*g*, and to the body 106. In some embodiments, the opening 326*g* can extend in a non-linear manner from the base 118, through the shiftable region 322*a*, and to the body 106. In some embodiments, the opening 326*a* can extend in a spiral or pinwheel manner from the base 118, through the shiftable region 322*g*, and to the body 106. In some embodiments, the shiftable region 322*g* can comprise multiple stays 324*g* (for example, a first stay, a second stay, etc.) and multiple openings 326*g*, where each stay 324*g* can be separated from an adjacent stay 324*g* by one of the openings 326*g*. For example, the shiftable region 322*g* can comprise six of the stays 324*a* and six of the openings 326*g*. In some embodiments, the stays 324*g* and the openings 326*g* can be arranged concentrically about the base 118. In some embodiments, the stays 324*g* can be the same shape and size.

Figure 3J:
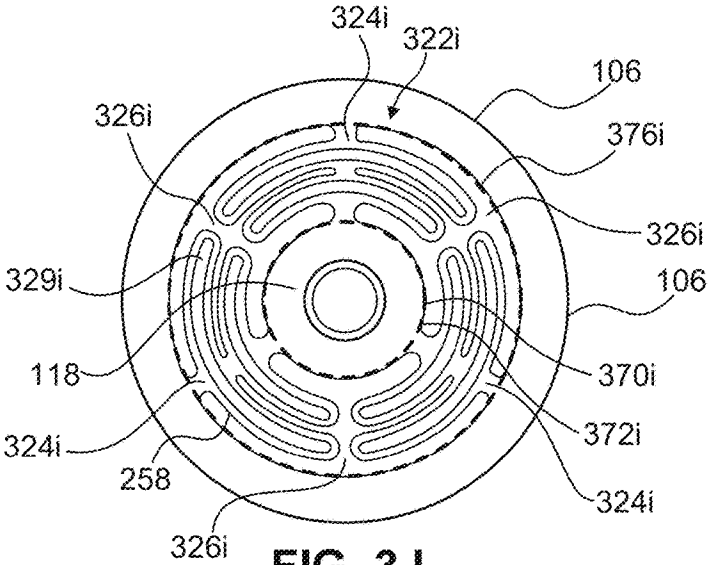
Figure 3L:
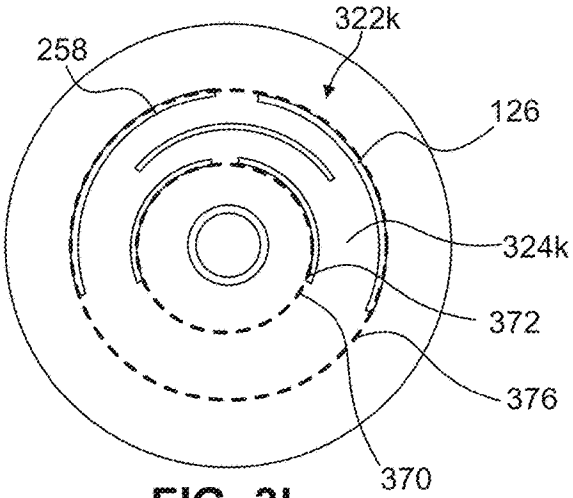
Figure 3I:
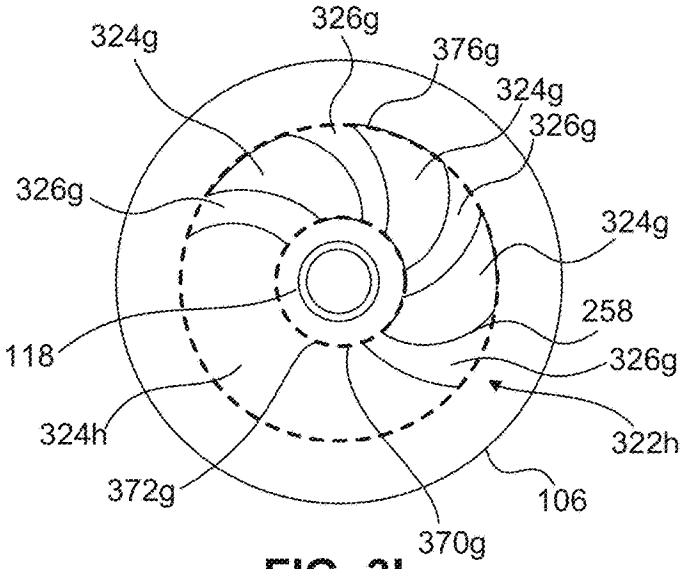

FIG. 3I shows a bottom view of a shiftable region 322*h*, according to some embodiments. In some embodiments, the shiftable region 322*h* can be similar to the shiftable region 322*g*, with the shiftable region 322*h* comprising at least one stay 324*h* that is a different size and/or shape than the stays 324*g*.

FIG. 3J shows a bottom view of a shiftable region 322*i*, according to some embodiments. Shiftable region 322*i* comprises a perimeter 376*i* and an interior boundary 370*i* located at an outer boundary 372*i* of the base 118. Shiftable region 322*i* comprises a stay 324*i* extending from the base 118, through the shiftable region 322*i*, and to the body 106. Shiftable region 322*i* also comprises an opening 326*i* can extend from the base 118, through the shiftable region 322*i*, and to the body 106. In some embodiments, the shiftable region 322*i* can comprise multiple stays 324*i* (for example, a first stay, a second stay, etc.) and multiple openings 326*i*, where each stay 324*i* can be separated from an adjacent stay 324*i* by one of the openings 326*i*. For example, the shiftable region 322*i* can comprise three of the stays 324*i* and three of the openings 326*i*. In some embodiments, the stays 324*i* and the openings 326*i* can be arranged concentrically about the base 118. In some embodiments, the shiftable region 322*i* can comprise an opening 329*i* that can be located within the stay 324*i* (for example, the opening 329*i* can be surrounded by the stay). In some embodiments, the shiftable region 322*i* can comprise multiple openings 329*i*, and the openings 329*i* can increase in size as they extend radially away from the base 118. In some embodiments, the stays 324*i*, the openings 326*i*, and the openings 329*i* can be arranged concentrically about the base 118. In some embodiments, one or more of the stays 324*i*, the openings 326*i*, and the openings 329*i* can comprise an arc shape.

Figure 3K:
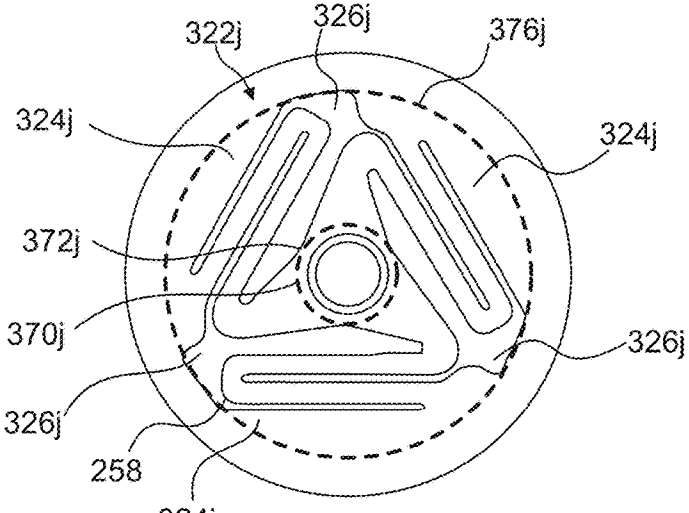

FIG. 3K shows a bottom view of a shiftable region 322*j*, according to some embodiments. Shiftable region 322*j* comprises a perimeter 376*j* and an interior boundary 370*j* located at an outer boundary 372*j* of the base 118. Shiftable region 322*j* comprises a stay 324*j* extending from the base 118, through the shiftable region 322*j*, and to the body 106. Shiftable region 322*j* also comprises an opening 326*j* extending from the base 118, through the shiftable region 322*j*, and to the body 106. In some embodiments, the opening 326*j* can extend in a non-linear manner from the base 118, through the shiftable region 322*j*, and to the body 106. In some embodiments, the opening 326*j* can extend in a serpentine or switchback manner from the base 118, through the shiftable region 322*j*, and to the body 106. In some embodiments, the shiftable region 322*j* can comprise multiple stays 324*j* (for example, a first stay, a second stay, etc.) and multiple openings 326*j*, where each stay 324*j* can be separated from an adjacent stay 324*j* by one of the openings 326*j*. For example, the shiftable region 322*j* can comprise 3 of the stays 324*j* and 3 of the openings 326*j*. In some embodiments, the stays 324*j* and the openings 326*j* can be arranged concentrically about the base 118.

FIG. 3L shows a bottom view of a shiftable region 322*k*, according to some embodiments. In some embodiments, the shiftable region 322*k* can be similar to the shiftable region 122 of FIG. 3A, with the only difference being the number and arrangement of the openings 126. For example, the shiftable region 322*k* can comprise openings 126 that partially surround the base 118 such that a portion of the stay 324*k* can extend linearly in a radial direction from the base 118 to the body 106 without crossing one of the openings 126. In some embodiments, the shiftable region 322*k* can comprise one stay 324*k* and five of the openings 126. In some embodiments, the shiftable region 122 can comprise more or fewer of the openings 126.

Figure 3M:
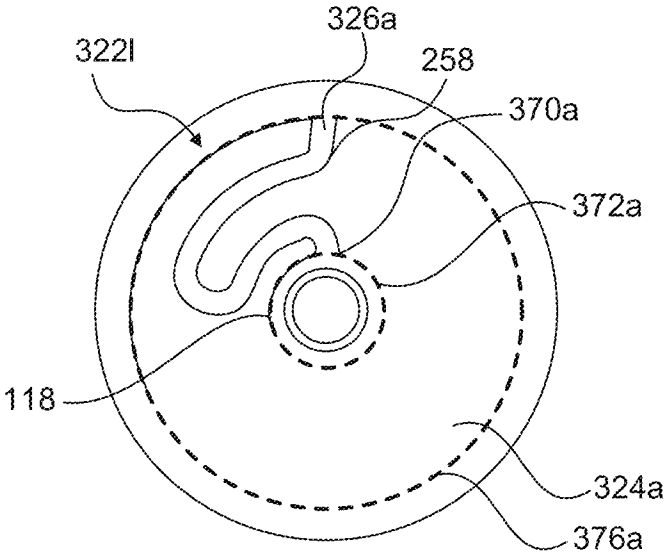

FIG. 3M shows a bottom view of a shiftable region 322*l*, according to some embodiments. In some embodiments, the shiftable region 322*l* can be similar to the shiftable region 322*a*, with the only difference being the number an arrangement of the openings 326*a*. For example, the shiftable region 322*l* can comprise only one of the openings 326*a* and only one stay 324.

In some embodiments, the sole 104 can comprise various combinations of any of the shiftable regions described herein. For example, the sole 104 can comprise at least one of each of the shiftable regions described herein (for example, the shiftable regions 122, 322*a*, 322*b*, 322*c*, 322*d*, 322*e*, 322*f*, 322*g*, 322*h*, 322*i*, 322*j*, 322*k*, and 322*l*) arranged on the sole 104. As another example, the sole 104 can comprise at least two of the shiftable regions described herein. As yet another example, the sole 104 can comprise at least three of the shiftable regions described herein, at least four of the shiftable regions described herein, and least five of the shiftable regions described herein, etc.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. An article of footwear, comprising:

an upper; and a sole coupled to the upper, the sole comprising:

a body;

a traction element comprising a base;

a shiftable region circumscribing the base and merging with the body at a perimeter of the shiftable region;

a stay extending from the base, through the shiftable region, and to the body; and an opening located in the shiftable region, the opening comprising an outermost point relative to the base, wherein the outermost point is located at the perimeter of the shiftable region, wherein the stay comprises an edge point at an outermost edge of the stay that is configured to move relative to the body when a force is imparted to the traction element.

2. The article of footwear of claim 1, comprising a cover disposed over the opening on a ground-facing surface of the sole.

3. The article of footwear of claim 1, comprising an elastically deformable material located in the opening.

4. The article of footwear of claim 3, wherein the elastically deformable material comprises a foam.

5. The article of footwear of claim 1, comprising an elastically deformable layer disposed over an upper-facing side of the sole.

6. The article of footwear of claim 5, wherein the elastically deformable layer comprises a foam.

7. The article of footwear of claim 1, wherein the body, the base, and the stay are integrally formed as a single piece.

8. The article of footwear of claim 1, wherein the traction element comprises a cleat.

9. The article of footwear of claim 1, wherein the sole comprises a plurality of the traction elements and a plurality of the shiftable regions, and each of the plurality of the traction elements is circumscribed by a respective one of the plurality of the shiftable regions.

10. The article of footwear of claim 1, wherein a radial distance between the edge point and the body is greater than or equal to 0.5 mm and less than or equal to 45 mm when the force is not imparted to the traction element.

11. The article of footwear of claim 1, wherein the edge point is configured to translate relative to the body when the force is imparted to the traction element.

12. The article of footwear of claim 11, wherein the edge point is configured to translate relative to the body along a first axis that is parallel to a longitudinal axis of the base, along a second axis that is parallel to a transverse axis of the base, and along a third axis that is orthogonal to the longitudinal axis and the transverse axis when the force is imparted to the traction element.

13. The article of footwear of claim 1, wherein the edge point is configured to rotate relative to the body when the force is imparted to the traction element.

14. The article of footwear of claim 13, wherein the edge point is configured to rotate relative to the body about a first axis that is parallel to a longitudinal axis of the base, about a second axis that is parallel to a transverse axis of the base, and about a third axis that is orthogonal to the longitudinal axis and the transverse axis when the force is imparted to the traction element.

15. The article of footwear of claim 1, wherein the shiftable region comprises an interior boundary located at an outer boundary of the base and comprises a first effective diameter, and wherein the perimeter of the shiftable region comprises a second diameter at least 2 mm greater than the first effective diameter.

16. The article of footwear of claim 1, wherein the stay is a first stay and the shiftable region comprises a second stay separated from the first stay by the opening.

17. The article of footwear of claim 1, wherein the stay comprises multiple connection points with the base.

18. The article of footwear of claim 1, wherein the shiftable region comprises a plurality of the openings, and each of the plurality of openings comprises an arc shape surrounding part of the base.

19. A sole for an article of footwear, comprising:

a body;

a traction element comprising a base;

a shiftable region circumscribing the base and merging with the body at a perimeter of the shiftable region;

a stay extending from the base, through the shiftable region, and to the body; and an opening located in the shiftable region, the opening comprising an outermost point relative to the base, wherein the outermost point is located at the perimeter of the shiftable region, wherein the stay comprises a first point at an outermost edge of the stay and the body comprises a second point, and the first point translates relative to the second point when a force is imparted to the traction element such that there is a change in distance between the first point and the second point.

20. The sole of claim 19, wherein the first point is configured to rotate relative to the second point when the force is imparted to the traction element such that there is a change in angle between the first point and the second point.

* * * * *